US007231964B2

(12) United States Patent
Hsieh

(10) Patent No.: US 7,231,964 B2
(45) Date of Patent: Jun. 19, 2007

(54) COOLING APPLIANCE FOR HOT BEVERAGES

(76) Inventor: Hsin-Mao Hsieh, No. 6, East Section, Chiao Nan Li, Industrial 6th Rd., Pingtung City, Pingtung Hsien (TW)

( * ) Notice: Subject to any disclaimer, the term of this patent is extended or adjusted under 35 U.S.C. 154(b) by 54 days.

(21) Appl. No.: 11/152,265

(22) Filed: Jun. 13, 2005

(65) Prior Publication Data

US 2006/0278376 A1 Dec. 14, 2006

(51) Int. Cl.
*F28D 1/047* (2006.01)

(52) U.S. Cl. ..... 165/122; 165/74

(58) Field of Classification Search ..... 165/122, 165/185, 73, 74, 80.1
See application file for complete search history.

(56) References Cited

U.S. PATENT DOCUMENTS

| | | | | |
|---|---|---|---|---|
| 3,023,293 | A * | 2/1962 | Cornish | 165/185 |
| 3,213,336 | A * | 10/1965 | McAdam | 165/80.3 |
| 4,982,783 | A * | 1/1991 | Fickett et al. | 165/80.1 |
| 5,650,912 | A * | 7/1997 | Katsui et al. | 165/122 |
| 2004/0050536 | A1 * | 3/2004 | Watanabe et al. | 165/104.33 |

* cited by examiner

*Primary Examiner*—Teresa J. Walberg
(74) *Attorney, Agent, or Firm*—James H. Walters

(57) ABSTRACT

A cooling appliance for cooling hot beverages has a base, a heat conducting bar and an electric fan. The heat conducting bar is mounted securely in the base. The electric fan is attached to the base. The heat conducting bar extends into the hot beverages and transmits heat to the base. The electric fan blows air to cool the base. Therefore the cooling appliance can cool the hot beverage in a very short time.

4 Claims, 4 Drawing Sheets

COOLING APPLIANCE FOR HOT BEVERAGES

BACKGROUND OF THE INVENTION

1. Field of the Invention

The present invention relates to a cooling appliance, especially to a cooling appliance that is used to cool hot beverages.

2. Description of Prior Arts

The pace of modern life is so hectic that people have little time to even consume cups of coffee, etc. When the hot beverages such like hot drinks and hot soups are prepared, they are so hot that people cannot drink them directly. The hot beverages need to be cooled for those people who are in a hurry whereby the drinks can be consumed timely without scalding tongues etc. Two conventional ways are used to cool the hot beverages; one of the conventional ways is to set the hot beverages aside for a while and the ambient cools them; the other way is to stir the hot beverages for a while. No matter which one of the conventional ways people use, it takes lots of time to cool the hot beverages that is irritating, inconvenient and unsatisfactory for the modern person.

The present invention provides a cooling appliance for hot beverages to mitigate or obviate the aforementioned problems.

SUMMARY OF THE INVENTION

The main objective of the present invention is to provide a cooling appliance to speed up the cooling time of the hot beverages. The cooling appliance has a base, a heat conducting bar and an electric fan. The heat conducting bar is mounted securely in the base. The fan is attached to the base. The heat conducting bar extends into the hot beverages and transmits heat to the base. The fan blows air to cool the base. Therefore the cooling appliance can cool the hot beverages in a very short time.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
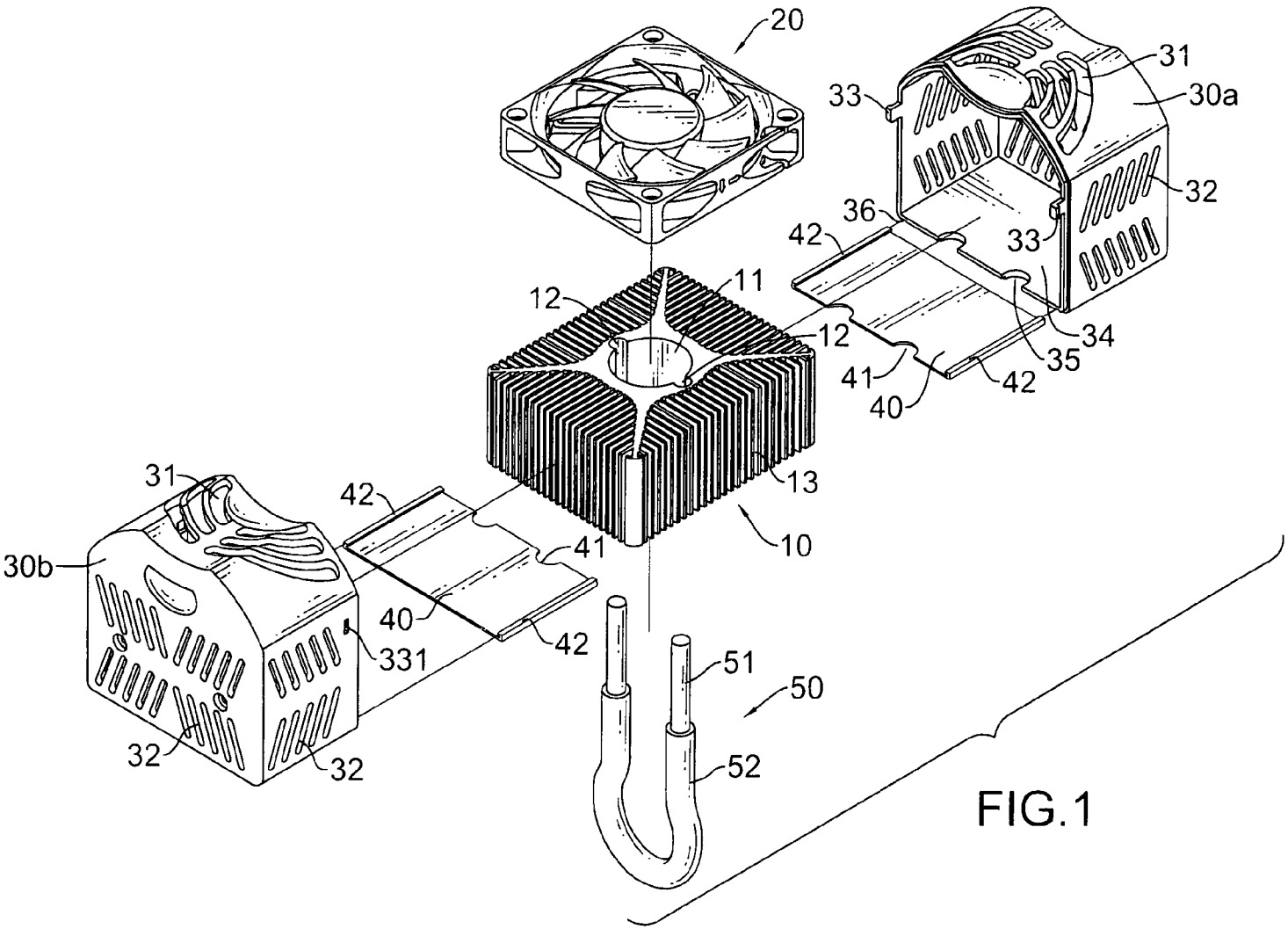
FIG. 1 is an exploded perspective view of a cooling appliance for hot beverages in accordance with the present invention.
Figure 2:
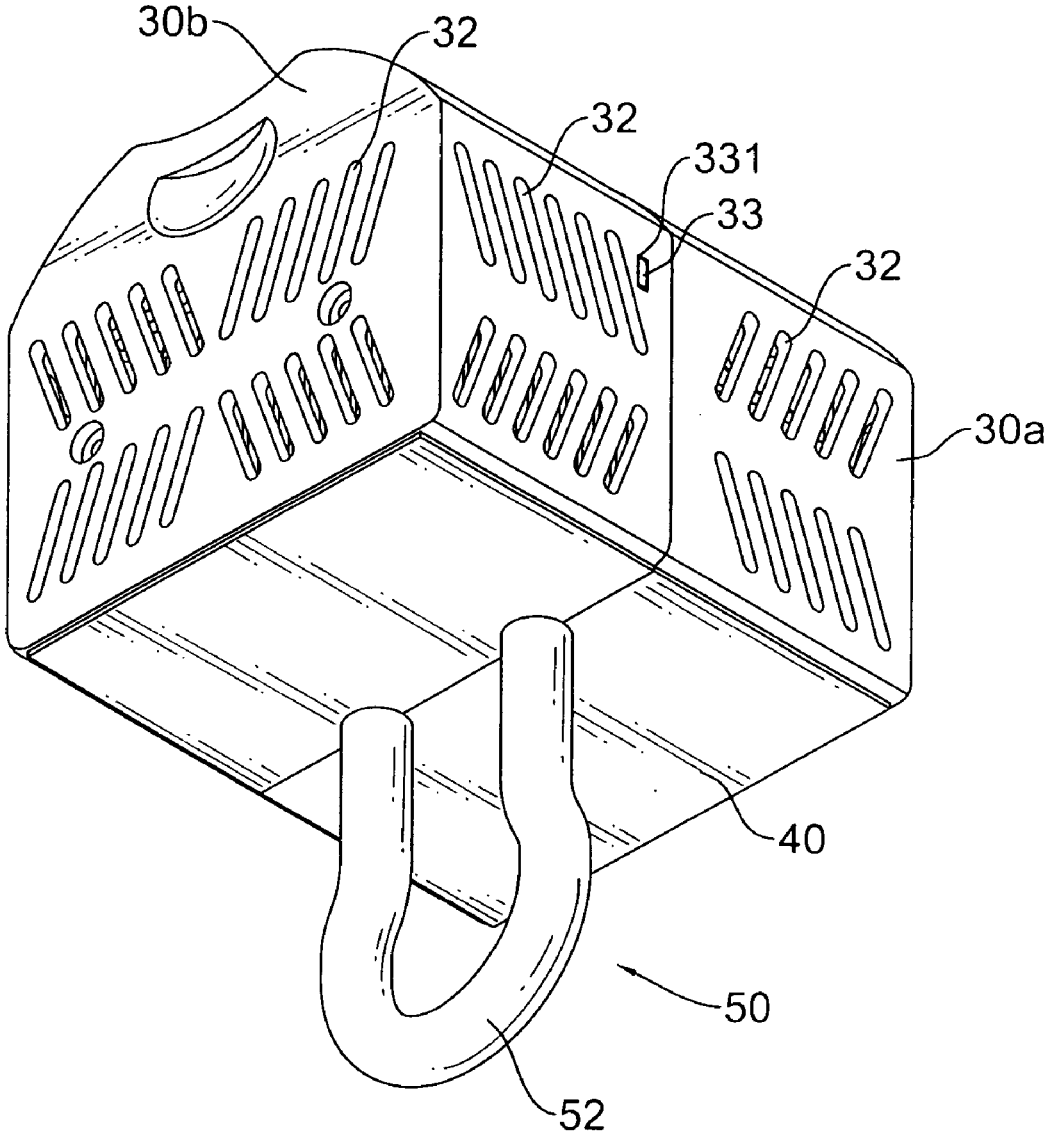
FIG. 2 is a perspective view of the cooling appliance in FIG. 1.

With reference to FIGS. 1 and 2, a cooling appliance for hot beverages in accordance with the present invention comprises a base (10), a heat conducting bar (50), an electric fan (20), an optional shell comprising two half portions (30*a,b*) and two optional positioning plates (40).

The base (10) has a top, a bottom, an optional central hole (11), at least one positioning hole (12) (two positioning holes (12) are shown in the preferred embodiment) in communication with the central hole (11), and multiple heat dissipating fins (13) surrounding the central hole (11). The positioning holes (12) are formed through the base (10) from the top to the bottom. The central hole (11) is formed through the base (10) from the top to the bottom. The heat dissipating fins (13) are formed on the base (10) to increase a contact surface area of the base (10) with ambient air.

The heat conducting bar (50) extends into a bottom of the base (10), is secured in the at least one positioning hole (12), may be U-shaped and may have two distal ends (51), a curved part and an anti-corrosion covering (52). The two distal ends (51) of the heat conducting bar (50) are secured respectively in the positioning holes (12). The anti-corrosion covering (52) is mounted on the curved part of the heat conducting bar (50) to keep the heat conducting bar (50) from corroding.

The electric fan (20) is attached to the top of the base (10) and can be powered in conventional ways, e.g. a mains supply or by battery.

Figure 3:
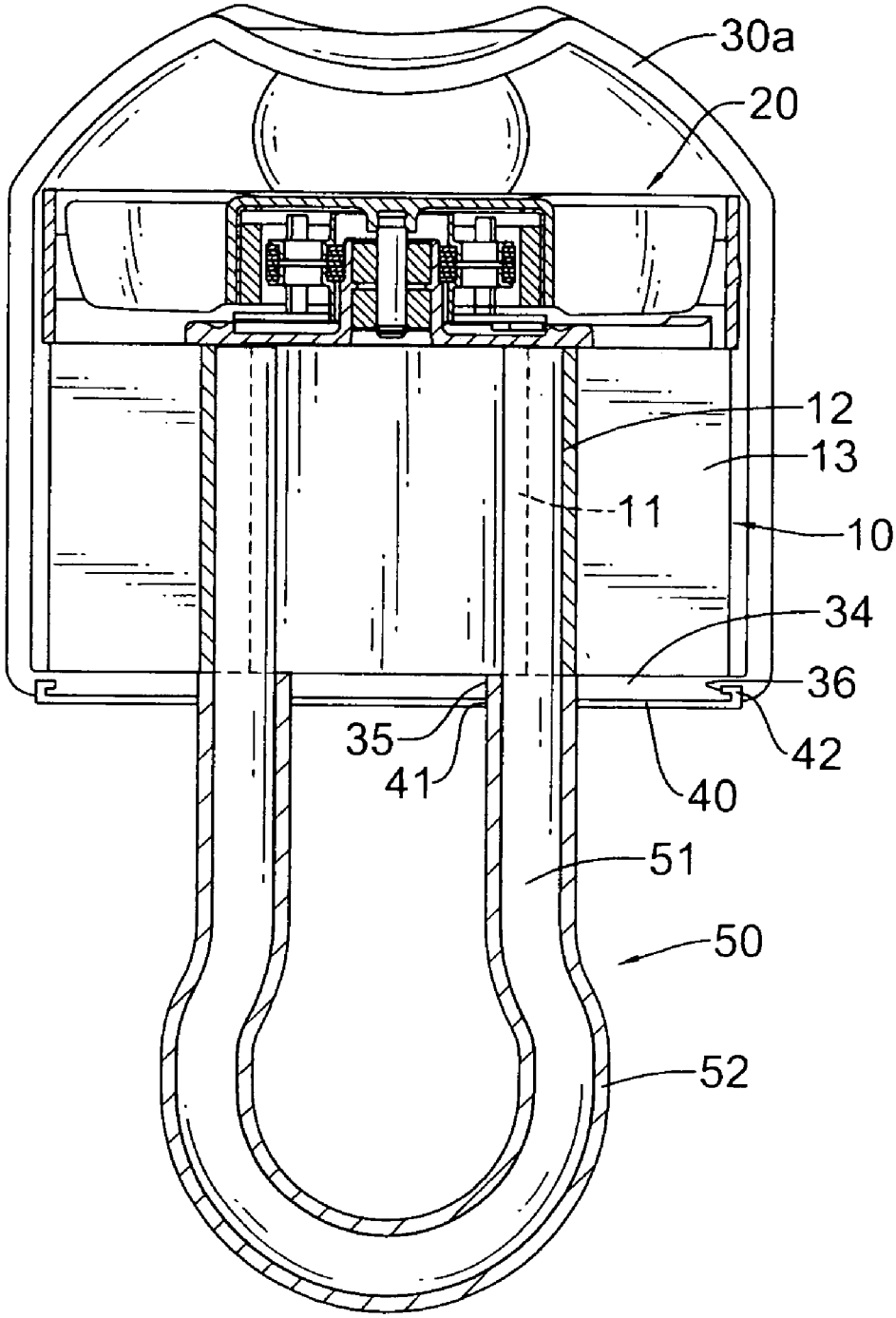
FIG. 3 is a side view in partial section of the cooling appliance in FIG. 1.

The shell halves (30*a,b*) are mounted around and enclose the base (10) and the fan (20), and each have has a top, sidewalls, multiple air inlets (31) and multiple air outlets (32). The air inlets (31) are formed through the top of the shell halves (30*a,b*). The air outlets (32) are formed through the sidewalls of the shell halves (30*a,b*). With further reference to FIG. 3, each shell half (30*a,b*) further has two sides, opening edges, a bottom (34), two recesses (35) and two sliding slots (36). The recesses (35) are formed in the bottom (34) of each shell half (30*a,b*) and respectively correspond to and hold the distal ends (51) of the heat conducting bar (50). The sliding slots (36) are formed in the bottom (34) respectively near the two sides of each shell half (30*a,b*). The first and second half shell (30*a,b*) combine with each other and the first shell half (30*a*) has two keys (33) and the second shell half 30*b*) has two keyholes (331). The keys (33) are formed on the opening edges of the first shell half (30*a*). The keyholes (331) are formed near the opening edges of the second shell half (30*b*) and corresponding to and engaging the keys (33) on the first half shell (30*a*). With the engagement of the keys (33) and the keyholes (331), the shell halves are combined together.

The positioning plates (40) are attached respectively to the shell halves (30*a,b*) and each positioning plate (40) has two sides, two longitudinal protrusions (42) and two recesses (41). The longitudinal protrusions (42) are formed respectively on the two sides of the positioning plate (40) and correspond to and engage the sliding slots (36) in the bottom (34) of the shell halves (30*a,b*). The recesses (41) are formed in the positioning plate (40) and respectively correspond to and hold the distal ends (51) of the heat conducting bar (50).

Figure 4:
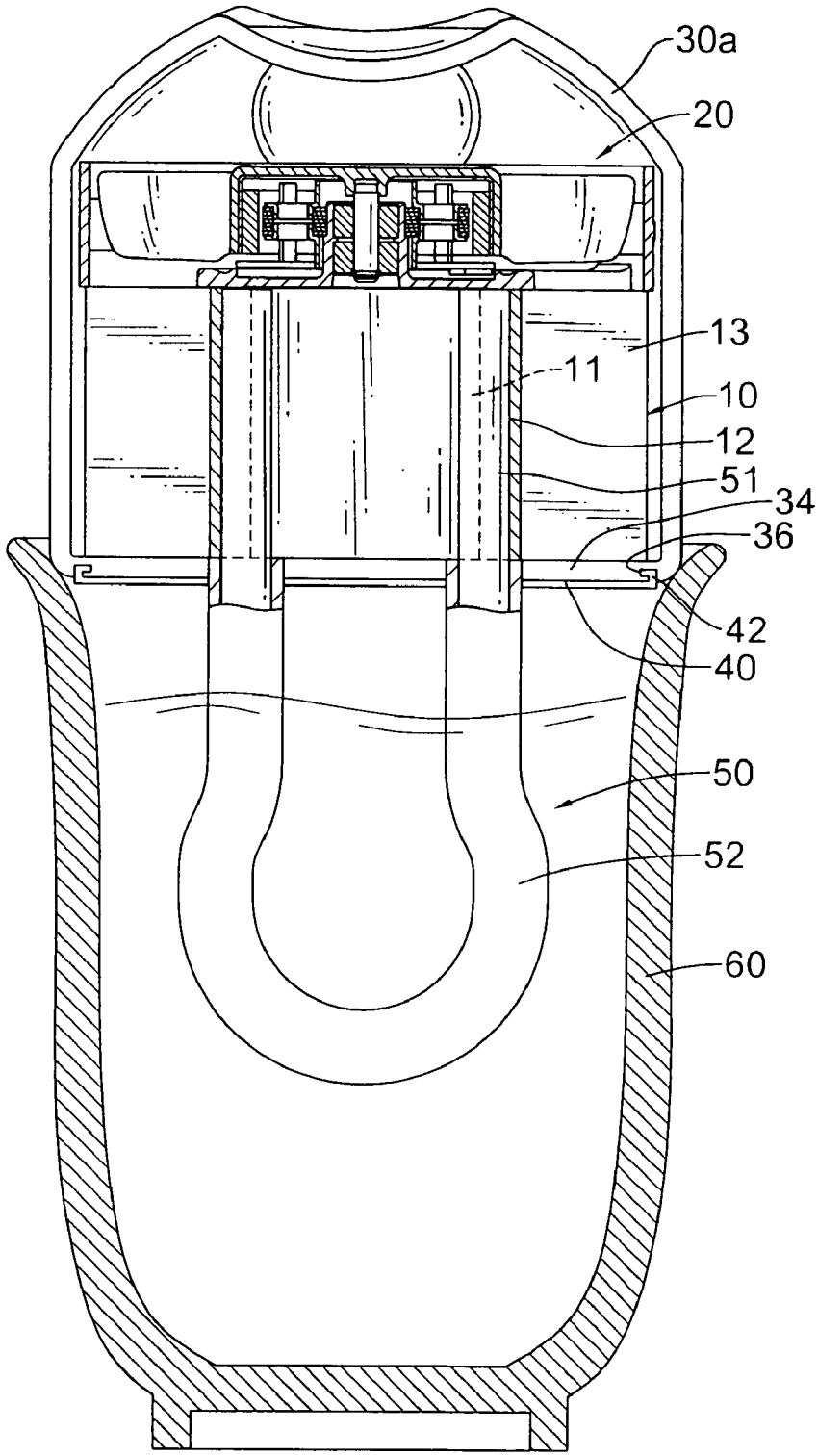
FIG. 4 is a side view in partial section of the cooling appliance in FIG. 1 mounted on a cup.

With reference to FIG. 4, the curved part of the heat conducting bar (50) is put into a cup (60) containing hot beverages. The heat conducting bar (50) transmits the heat to the base (10). The air is drawn into the shell via the air inlets (31). The fan (20) is operated to cool the base (10) by blowing the air out of the air outlets (32). With the heat conducting bar (50) and the fan (20), the cooling appliance can cool the hot beverages in a very short time.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cooling appliance comprising a base having a top;

a bottom;

two positioning holes formed through the base from the top to the bottom;

a central hole formed through the base from the top to the bottom in communication with the positioning holes; and multiple fins formed on the base;

a U-shaped heat conducting bar extending into the bottom of the base, secured in the positioning holes and having two distal ends secured respectively in the positioning holes; and a curved part extending between the distal ends;

an electric fan attached to the top of the base and adapted to be powered by an electricity supply; and a shell mounted around and covering the base and the fan and having a top;

at least two sidewalls;

multiple air inlets formed through the top of the shell; and multiple air outlets formed through the at least two sidewalls of the shell.

2. The cooling appliance as claimed in claim 1, wherein the shell is divided into a first shell half having two sides;

opening edges;

a bottom;

two keys formed on the opening edges;

two recesses formed in the bottom and respectively corresponding to and holding the distal ends of the heat conducting bar; and two sliding slots formed in the bottom respectively near the two sides of the first shell half; and a second shell half combining with the first shell half and having two sides;

opening edges;

a bottom;

two keyholes formed through the second shell half and near the opening edges and corresponding to and engaging the keys on the first shell half;

two recesses formed in the bottom and respectively corresponding to and holding the distal ends of the heat conducting bar; and two sliding slots formed in the bottom respectively near the two sides of the second shell half; and two positioning plates attached respectively to the shell halves and each positioning plate having two sides;

two longitudinal protrusions formed respectively on the two sides of the positioning plate and corresponding to and engaging the sliding slots in the bottom of the respective shell half; and two recesses formed in the respective positioning plate and respectively corresponding to and holding the distal ends of the heat conducting bar.

3. The cooling appliance as claimed in claim 1, wherein the heat conducting bar has an anti-corrosion covering mounted on the curved part of the heat conducting bar.

4. The cooling appliance as claimed in claim 2, wherein the heat conducting bar has an anti-corrosion covering mounted on the curved part of the heat conducting bar.

* * * * *